US008998656B2

(12) United States Patent
Amano et al.

(10) Patent No.: US 8,998,656 B2
(45) Date of Patent: Apr. 7, 2015

(54) TERMINAL FITTING HAVING AUXILIARY SPRING WITH SUPPORT

(71) Applicant: Sumitomo Wiring Systems, Ltd., Yokkaichi, Mie (JP)

(72) Inventors: Takamaru Amano, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 141 days.

(21) Appl. No.: 13/866,264

(22) Filed: Apr. 19, 2013

(65) Prior Publication Data

US 2013/0288548 A1 Oct. 31, 2013

(30) Foreign Application Priority Data

Apr. 26, 2012 (JP) ..... 2012-101373

(51) Int. Cl.
*H01R 11/22* (2006.01)
*H01R 13/11* (2006.01)
*H01R 13/187* (2006.01)

(52) U.S. Cl.
CPC ..... *H01R 13/187* (2013.01); *H01R 13/113* (2013.01)

(58) Field of Classification Search
USPC ..... 439/852, 845, 843, 847, 851
See application file for complete search history.

(56) References Cited

U.S. PATENT DOCUMENTS

| | | | | |
|---|---|---|---|---|
| 4,357,066 | A * | 11/1982 | Cairns et al. | 439/862 |
| 4,838,816 | A * | 6/1989 | Matsusaka et al. | 439/861 |
| 6,547,608 | B2 * | 4/2003 | Sato et al. | 439/852 |
| 7,503,813 | B1 * | 3/2009 | Osterhart | 439/852 |
| 8,333,622 | B2 * | 12/2012 | Blasko et al. | 439/852 |
| 2013/0288545 | A1 * | 10/2013 | Amano et al. | 439/817 |
| 2013/0288547 | A1 * | 10/2013 | Amano et al. | 439/852 |

FOREIGN PATENT DOCUMENTS

JP 2004-362832 12/2004

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A terminal fitting (T) includes a rectangular tube (2) into which a mating terminal (M) is to be inserted. A tongue (11) is cantilevered backward in the tube (2). A support (35) struck from the bottom plate (3) to project into the rectangular tube (2) from the bottom plate (3). An auxiliary spring (15) cantilevers forward from the support (35). Opposite widthwise sides of this support (35) are continuous with the bottom plate (3). The base end part of the auxiliary spring (15) is lifted up from the bottom plate (3) by forming the support (35). Thus, the base end part does not project from the bottom plate (3) even if the auxiliary spring (15) is resiliently deformed.

13 Claims, 6 Drawing Sheets

TERMINAL FITTING HAVING AUXILIARY SPRING WITH SUPPORT

BACKGROUND

1. Field of the Invention

The invention relates to a terminal fitting.

2. Description of the Related Art

Japanese Unexamined Patent Publication No. 2004-362832 discloses a terminal fitting that has a rectangular tube. A tongue is cantilevered backward into the rectangular tube. The tongue comes into sliding contact with a tab of a mating terminal and is deformed downward. There is also an auxiliary spring behind the tongue in the rectangular tube. The auxiliary spring has a fixed rear end and a free front end that extends in a direction opposite to the tongue. When the tongue is deformed, the lower surface of the tongue comes into contact with the front end of the auxiliary spring and causes the auxiliary spring to deform downward together with the tongue.

The auxiliary spring is formed by being cut and bent from the bottom plate of the rectangular tube portion. Cuts are made in the bottom plate from the front edge of the auxiliary spring to opposite widthwise side edges of the bottom plate and then along the opposite widthwise side edges of the bottom plate so that the only portion of the bottom plate that is continuous from edge to opposite widthwise edge is the base end of the auxiliary spring. A short portion of the auxiliary spring extending forward from the ends of the cuts made along the opposite widthwise side edges of the bottom plate is flush with the inner surface of the bottom plate and serves as a support. The portion of the auxiliary spring that does not serve as a support is gradually raised from the support toward the tongue.

When the auxiliary spring is deformed, part of the base end of the auxiliary spring may easily project outward from the bottom plate because it is closer than the support to the cuts made in the opposite widthwise edges of the bottom plate. If part of the base end of the auxiliary spring does project outward it may interfere with the bottom wall of a cavity of a connector housing and change the auxiliary spring property of the auxiliary spring.

The invention was completed to provide a terminal fitting configured such that a base end part of an auxiliary spring does not project outward from a base plate even if the auxiliary spring piece is deformed.

SUMMARY OF THE INVENTION

The invention provides a terminal fitting with a tube into which a mating terminal is to be at least partly inserted. The tube has a tongue that is deformable by contact with the mating terminal and at least one cantilevered auxiliary spring cut and raised from a base plate of the tube. The auxiliary spring has a contact portion that comes into contact with the tongue and is deformable with the tongue. A support is formed on a base end of the auxiliary spring and projects in from the base plate of the tube to the base end of the auxiliary spring. If the auxiliary spring is deformed, the base end of the auxiliary spring does not project outward from the base plate of the tube because the support projects in from the base plate of the tube.

Part of the auxiliary spring continuous with a front end of the support is shaped to extend in toward the interior off the tube to form at least one step with a height equal to that the height of the support. The step reinforces the support of the auxiliary spring, which is at the periphery of this step, thereby increasing rigidity and helping to ensure the contact load for the mating terminal.

The auxiliary spring may get gradually narrower from the base end to the leading end of the auxiliary spring piece with the leading end being the narrowest. Rigidity is increased at the base end of the auxiliary spring because the base end is wider than the leading end. This increased rigidity further ensures the contact load for the mating terminal.

The leading end of the auxiliary spring preferably extends toward the tongue with a moderate upward inclination and may curve upward to form a tongue contact portion.

The tongue preferably is folded backward from the base plate to form a folded portion.

A length area of the tongue adjacent to the folded portion preferably becomes gradually narrower toward the back and an area at or near a rear end part of the tongue becomes wider and bulges out towards opposite widthwise sides.

A base end of the auxiliary spring preferably is connected to the rear opening edge of a punched hole.

The auxiliary spring preferably shares a widthwise center line with the tongue and preferably is bilaterally symmetrical with the tongue.

The width of the base end part of the auxiliary spring preferably is narrower than the width of the rear side of the opening edge of a punched hole.

The support preferably is rigid and does not easily deform even if the auxiliary spring is deformed.

The height of the step preferably is larger than that of the support.

These and other objects, features and advantages of the invention will become more apparent upon reading the following detailed description of the preferred embodiments and the accompanying drawings. It should be understood that even though embodiments are separately described, single features thereof may be combined to form additional embodiments.

DETAILED DESCRIPTION OF THE PREFERRED EMBODIMENTS

Figure 2:
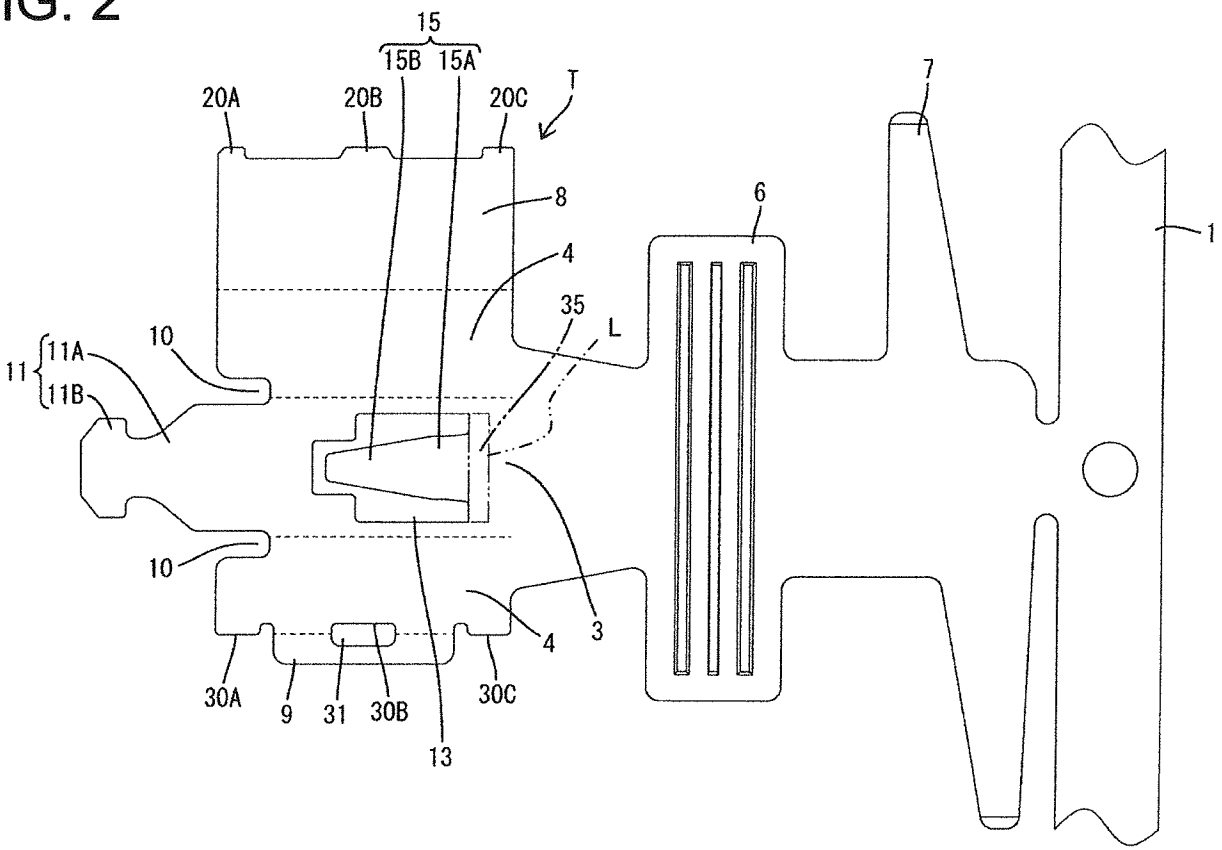
FIG. 2 is a development of the terminal fitting.

As shown in FIG. 2, a terminal fitting is formed by bending, folding and/or embossing and striking or hammering a conductive plate material punched or cut out into a specified development shape. A multitude of developed terminal fittings T are coupled side by side to a carrier 1 in a chain-like manner.

Figure 1:
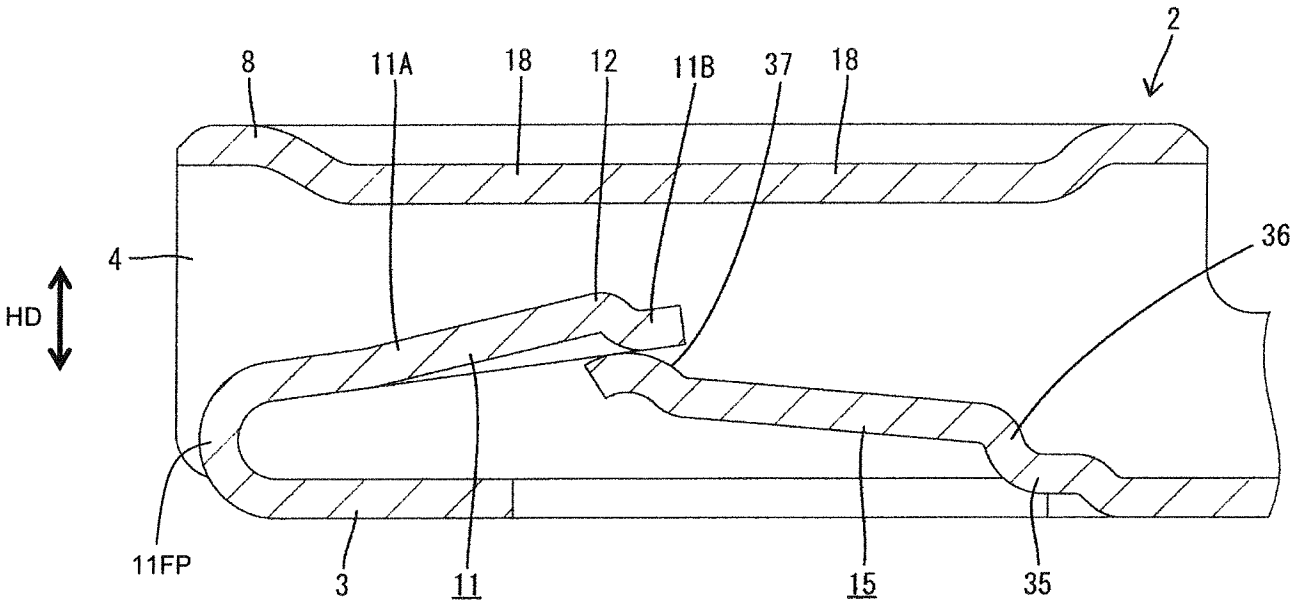
FIG. 1 is a side view in section of a terminal fitting.

The terminal fitting T has opposite front and rear ends. A tube 2 is formed at the front end, as shown in FIG. 1, and a wire connection portion is formed at the rear end, as shown in FIG. 2. The wire connecting portion has at least one wire barrel 6 to be crimped, bent or folded and connected to a wire core and at least one insulation barrel 7 to be crimped, bent or folded and connected to a wire coating.

The tube 2 includes a bottom or base plate 3, lateral (left and right) side plates 4, at least one ceiling plate 8 and a pressing portion 9. In forming the rectangular tube 2, both side plates 4 are bent at an angle, preferably at a right angle from the opposite left and right sides of the bottom plate 3 and the ceiling plate 8 is bent at an angle, preferably at a right angle from the upper edge of one side plate 4 toward the other side in parallel to the bottom plate 3. As shown in FIG. 1, the ceiling plate 8 is struck or hammered in toward the tube 2 to form a ceiling plate side contact portion 18 over a specified range along a longitudinal direction.

As shown in FIG. 2, three projecting pieces 20A to 20C bulge out on the extending end edge of the ceiling plate 8. The projecting pieces 20A, 20C located on the front and rear ends come into contact with receiving portions 30A, 30C provided at corresponding positions of the upper end edge of the other side plate 4 in forward and backward directions by being placed from outside or above. As shown in FIG. 2, a pressing portion 9, in which a window hole 31 is formed, projects from the upper edge of the other side plate 4. The pressing portion 9 is bent to be placed on the extending end edge of the ceiling plate 8 to prevent the opening of the tube 2.

The projecting piece 20B located in the the intermediate position comes or can come into contact with a receiving portion 30B formed on or at the lower edge of the window hole 31 by being placed from above.

As shown in FIG. 2, two laterally spaced grooves 10 are formed on or near the front of the bottom plate 3 and a tongue 11 extends forward from an area of the bottom plate 3 between the grooves 10. The tongue 11 can come into contact with the lower surface of a mating terminal M. This tongue 11 is folded or bent backward in the tube 2 thereby forming a folded portion 11FP. The folded part is arcuately curved and the tongue 11 is resiliently deformable in a height direction HD with the folded part as a support. As shown in FIG. 2, a length area of the tongue 11 behind the folded part 11FP is composed of an area 11A that becomes gradually narrower toward the back and an area 11B arranged at or near a rear end part that is wider and bulges out toward opposite widthwise sides. A tongue contact portion 12 is formed by striking or hammering the tip part of the tongue piece 11 upwardly or inwardly. The tongue contact portion 12 can come into contact with the mating terminal M and sandwich the mating terminal M between itself and the ceiling plate 8 (particularly the ceiling plate contact portion 18).

As shown in FIGS. 1 and 2 a punched hole 13 is formed in a longitudinally intermediate part of the bottom plate 3. This punched hole 13 functions as a locking hole, into which a locking lance (not shown) for retaining the terminal fitting T in a connector housing is inserted after an auxiliary spring 15 is bent and raised or projected inward.

As shown in FIG. 2, a base end part of the auxiliary spring 15 is connected to the rear side of the opening edge of the punched hole 13. The auxiliary spring 15 shares a widthwise center line with the tongue 11 and is bilaterally symmetrical with respect to the widthwise center line of the tongue 11.

Figure 4:
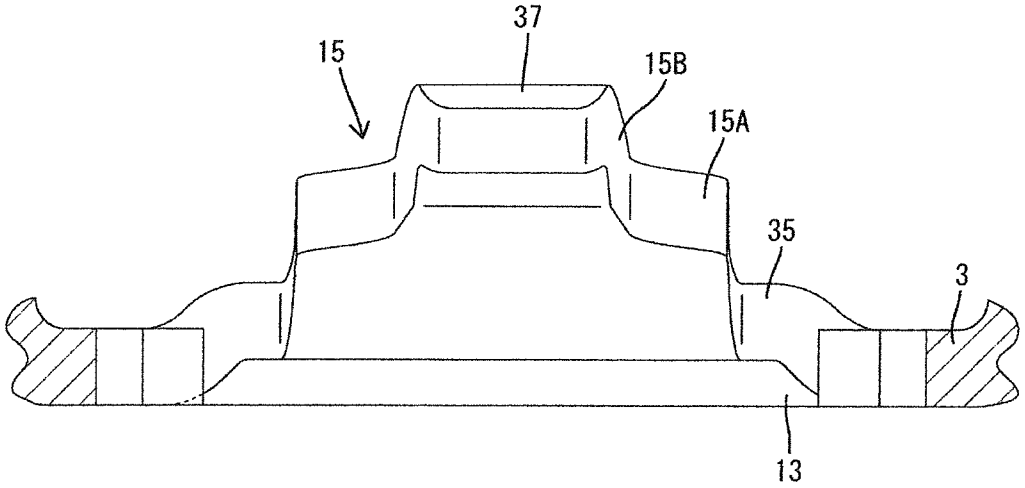
FIG. 4 is a front view of the auxiliary spring piece.
Figure 5:
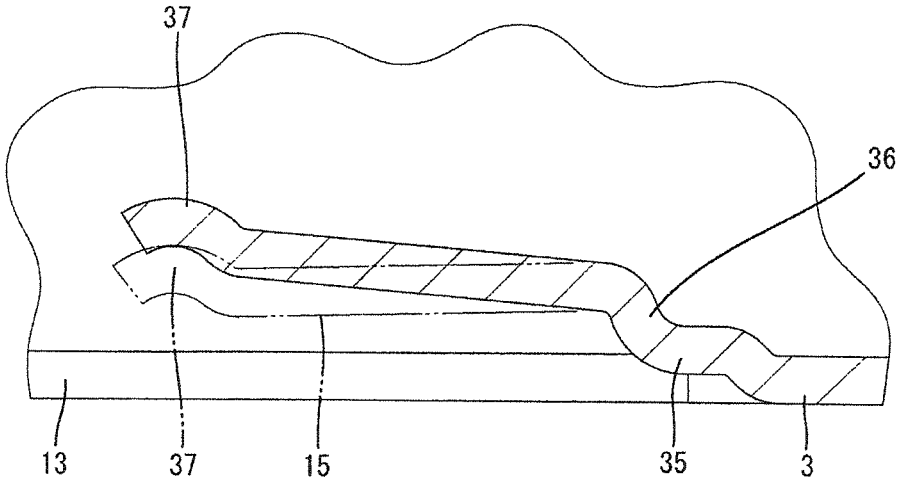
FIG. 5 is a side view in section showing states before and after the resilient deformation of the auxiliary spring piece.

The width of the base end part of the auxiliary spring 15 is narrower than the width of the rear side of the opening edge of the punched hole 13. An area behind or near the rear side of the opening edge of the punched hole 13 and/or having the same width as this rear side (area long and narrow in the width direction and enclosed by imaginary line L in FIG. 2) is struck or deformed in toward the bottom plate 3 of the tube 2 to form a support 35. Opposite widthwise sides and a rear end of this support 35 are continuous with the bottom plate 3. The opposite widthwise sides and the rear end of this support 35 project inward from the bottom plate 3 (see FIGS. 1 and 4) and the upper or inner surface of the support 35 is a flat surface parallel to the bottom plate 3.

The auxiliary spring 15 is continuous with the front of this support 35, extends forward toward the tongue 11 and is deformable. The support 35 has enough rigidity as a result of its thickness and/or shape as not to be easily deformed even if the auxiliary spring 15 is deformed.

Figure 3:
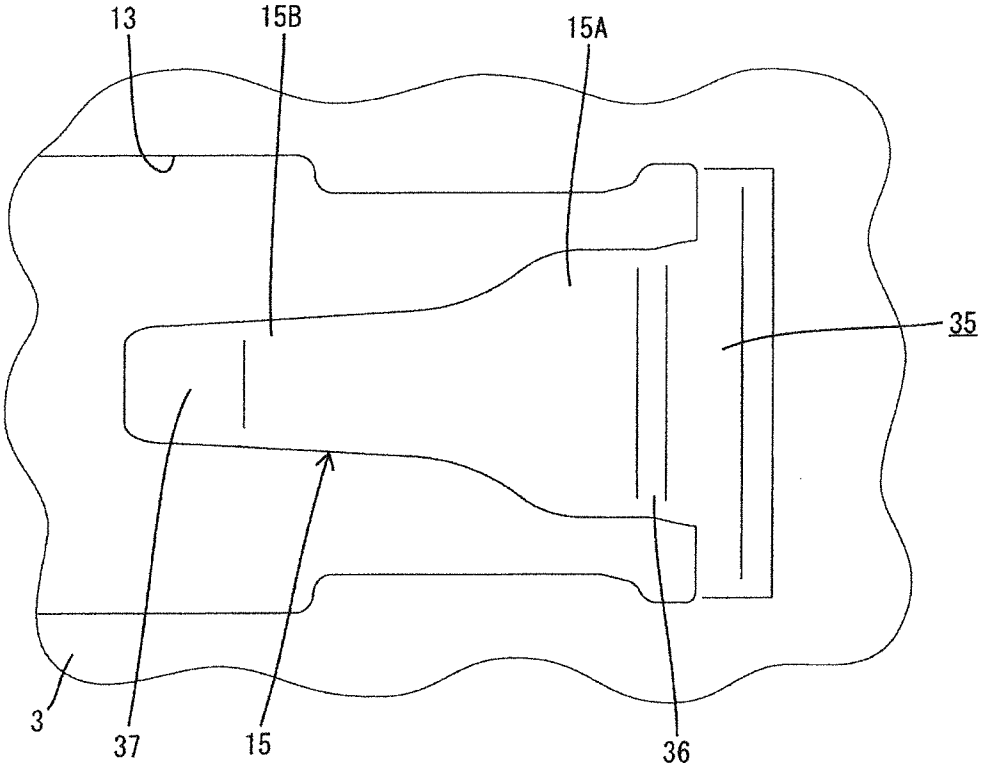
FIG. 3 is a plan view of an auxiliary spring piece.

As shown in FIGS. 1 to 3, the auxiliary spring 15 is composed of a wide portion 15A and a narrow portion 15B. The wide portion 15A has a uniform width and is connected to the support 35. The narrow portion 15B is before and adjacent to the wide portion 15A and becomes gradually or stepwisely narrower toward the leading end. The wide portion 15A is struck, deformed or hammered upward to form at least one step 36. The striking or projecting height of the step 36 is larger than that of the support 35. The narrow portion 15B of the auxiliary spring 15 extends toward the tongue 11 with a moderate upward inclination and the extending end thereof curves upward to form an auxiliary contact portion 37. The auxiliary contact portion 37 of the auxiliary spring 15 is held in contact with the lower surface of the tongue 11, but may be slightly spaced apart in a natural state and/or may come into contact after the start of the resilient deformation of the tongue 11.

Figure 6:
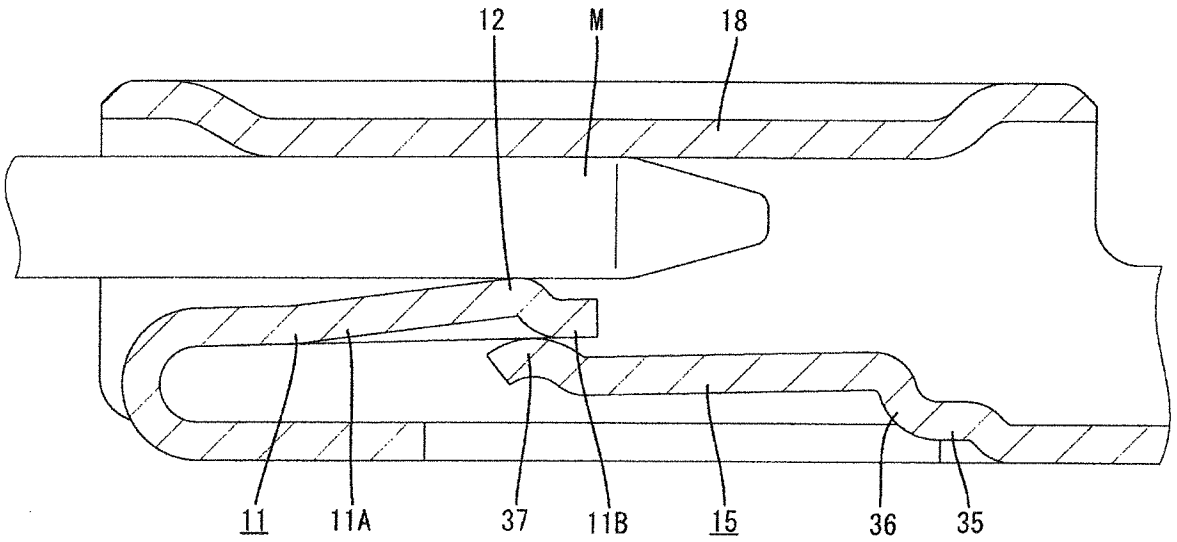
FIG. 6 is a side view in section showing a state where a mating terminal is inserted in a rectangular tube portion.

When being inserted into the tube 2, the mating terminal M moves forward while sliding in contact with the upper or inner surface of the tongue 11. The tongue 11 is resiliently deformed outward or toward the bottom plate 3 during this process and, after the deformation of the tongue, the auxiliary spring 15 is also resiliently deformed with a part around the step 36 as a support. When the mating terminal M is inserted to a proper depth in the rectangular tube 2, as shown in FIG. 6, the mating terminal M is held in a state sandwiched between the ceiling plate 8 (particularly the ceiling plate contact portion 18) and the tongue contact portion 12. At this time, the mating terminal M receives a contact load based on spring forces of both the tongue 11 and the auxiliary spring 15.

The support 35 formed on the base end of the auxiliary spring 15 is struck, hammered or deformed to project from the bottom plate 3 and is continuous with the bottom plate 3. The base end of the auxiliary spring 15 does not project outward from the bottom plate 3 even if the auxiliary spring 15 is resiliently deformed because it is deformed, spaced inwardly and lifted up from the bottom plate 3 by the support 35; therefore, the desired spring property is ensured for the auxiliary spring 15. The rigidity of the base end part of the auxiliary spring 15 is increased because it is struck or shaped in a step-like or raised manner to form the step 36 and the because the base end thereof is wider than the leading end thereof. The auxiliary spring 15 can extend at a moderate angle because the base end of the auxiliary spring 15 is elevated, displaced or spaced inwardly by the step 36.

The rigidity of the bottom plate 3 of the tube 2 is also increased by forming the support 35.

The invention is not limited to the above described and illustrated embodiment. The following embodiments are also included in the technical scope of the invention.

The auxiliary spring 15 may extend toward the tongue 11 directly from the support 35 without the step 36.

The tongue 11 and the auxiliary spring 15 can extend in the same direction (e.g. both the tongue 11 and the auxiliary spring 15 can extend forward).

What is claimed is:

1. A terminal fitting, comprising:

a tube into which a mating terminal is to be at least partly inserted, the tube including a base plate;

a resiliently deformable tongue arranged in the tube and being deformable by contact with the mating terminal;

a support unitary with the base plate and projecting into the tube; and at least one resiliently deformable auxiliary spring cantilevered from the support and into the tube, the auxiliary spring including a contact portion that comes into contact with the tongue, and resiliently deforms together with the tongue, a part of the auxiliary spring continuous with a front of the support is shaped to form at least one step having a height difference from the support.

2. The terminal fitting of claim 1, wherein the auxiliary spring has a wide portion in proximity to the support and a narrow portion that becomes gradually narrower from the wide portion toward a leading end of the auxiliary spring, the narrow portion of the auxiliary spring extending toward the tongue with a moderate upward inclination and the extending end of the narrow portion being curved to form a convex contact portion facing the tongue.

3. The terminal fitting of claim 1, wherein the tongue is folded backward from the base plate to form a folded portion.

4. The terminal fitting of claim 3, wherein a length area of the tongue adjacent to the folded portion comprises an area that becomes gradually narrower toward the back and a wide area at or near a rear end part, the wide area bulging out toward opposite widthwise sides.

5. The terminal fitting of claim 1, wherein a base end part of the auxiliary spring piece is connected to a rear end of a punched hole.

6. The terminal fitting of claim 1, wherein the auxiliary spring and the tongue have center lines that align with one another.

7. The terminal fitting of claim 1, wherein the auxiliary spring is bilaterally symmetrical with the tongue.

8. The terminal fitting of claim 1, wherein the auxiliary spring is formed by punching a punched hole in the base plate and a base end of the auxiliary spring adjacent the support is narrower than the punched hole.

9. The terminal fitting of claim 1, wherein the support is shaped to have sufficient rigidity to remain substantially undeformed when the auxiliary spring is resiliently deformed.

10. The terminal fitting of claim 1, wherein a projecting height of the step from the support is larger than a projecting height of the support from the base plate.

11. A terminal fitting, comprising:

a substantially rectangular tube with opposite front and rear ends and a base plate;

a resiliently deformable tongue cantilevered rearward from a front end of the tube and projecting into the tube;

a support unitary with the base plate and projecting into the tube; and a resiliently deformable auxiliary spring having a step projecting in from a front end of the support and being cantilevered forward from the step and into the tube, the auxiliary spring including a contact portion that comes into contact with the tongue, and resiliently deforms together with the tongue.

12. The terminal fitting of claim 11, wherein a projecting height of the step from the support is larger than a projecting height of the support from the base plate.

13. The terminal fitting of claim 11, wherein opposite sides of the support and a rear end of the support are unitary with the base plate so that the support substantially avoids deformation in response to resilient deformation of the auxiliary spring.

* * * * *